US005394566A

United States Patent [19]

Hong

[11] Patent Number: 5,394,566

[45] Date of Patent: Mar. 7, 1995

[54] COLD WEATHER VENTILATION SYSTEM FOR FACESHIELD DEFOGGING

[75] Inventor: Scott S. Hong, Cerritos, Calif.

[73] Assignee: Hong Jin Crown America, Inc., Cerritos, Calif.

[21] Appl. No.: 166,529

[22] Filed: Dec. 14, 1993

[51] Int. Cl.[6] ..... A42B 1/08

[52] U.S. Cl. ..... 2/424; 2/171.3; 2/422

[58] Field of Search ..... 2/410, 424, 425, 171.3, 2/171.4, 422, 6.3, 6.4, 6.5, 6.7

[56] References Cited

U.S. PATENT DOCUMENTS

| | | | |
|---|---|---|---|
| 4,047,249 | 9/1977 | Booth | 2/424 |
| 4,101,980 | 7/1978 | Stepan et al. | 2/424 |
| 4,315,335 | 2/1982 | Kennedy, Jr. et al. | 2/424 |
| 4,354,285 | 10/1982 | Rudd | 2/424 |
| 4,462,119 | 7/1984 | Rudd | 2/424 |
| 4,498,202 | 2/1985 | Yamamoto | 2/424 |
| 4,612,675 | 9/1986 | Broersma . | |
| 4,698,856 | 10/1987 | Arai | 2/425 |
| 4,704,746 | 11/1987 | Nava . | |
| 5,005,221 | 4/1991 | Chen | 2/424 |
| 5,058,212 | 10/1991 | Kamata | 2/424 |
| 5,093,937 | 3/1992 | Kamata | 2/424 |
| 5,093,938 | 3/1992 | Kamata . | |
| 5,170,510 | 12/1992 | Nava . | |
| 5,212,843 | 5/1993 | Kamata | 2/424 |

FOREIGN PATENT DOCUMENTS 135812 4/1985 European Pat. Off. ..... 2/424

*Primary Examiner*—Clifford C. Crowder
*Assistant Examiner*—Michael A. Neas
*Attorney, Agent, or Firm*—Poms, Smith, Lande & Rose

[57] ABSTRACT

A replacement sports helmet face shield assembly has a cold-weather ventilation system for face shield defogging without circulating cold air through the interior of the sports helmet. The assembly has a face shield frame that carries a face shield. The frame has a lower face shield frame vent and an upper face shield frame vent. The upper portion of the frame may have an air flow director which, when the assembly is mounted on a sports helmet, directs air entering the upper frame vent. The directed air flow creates a vacuum that draws air entering the lower frame vent substantially upward along an interior surface of said face shield. A sports helmet assembly has a versatile, adjustable ventilation system which can operate in a defog-only mode in cold weather, a defog and interior ventilation mode in warmer weather, and an interior ventilation-only mode when no defogging is desired. The assembly includes a sports helmet with at least one helmet air entry vent on a front portion of the helmet and at least one air exit vent on a rear helmet portion. The helmet assembly also includes a face shield frame that carries a face shield and is rotatably mounted onto the sports helmet. The frame has lower and upper frame vents located on the lower frame portion. The helmet entry vent and the frame vents may be selectively opened and closed.

20 Claims, 3 Drawing Sheets

FIG. 4
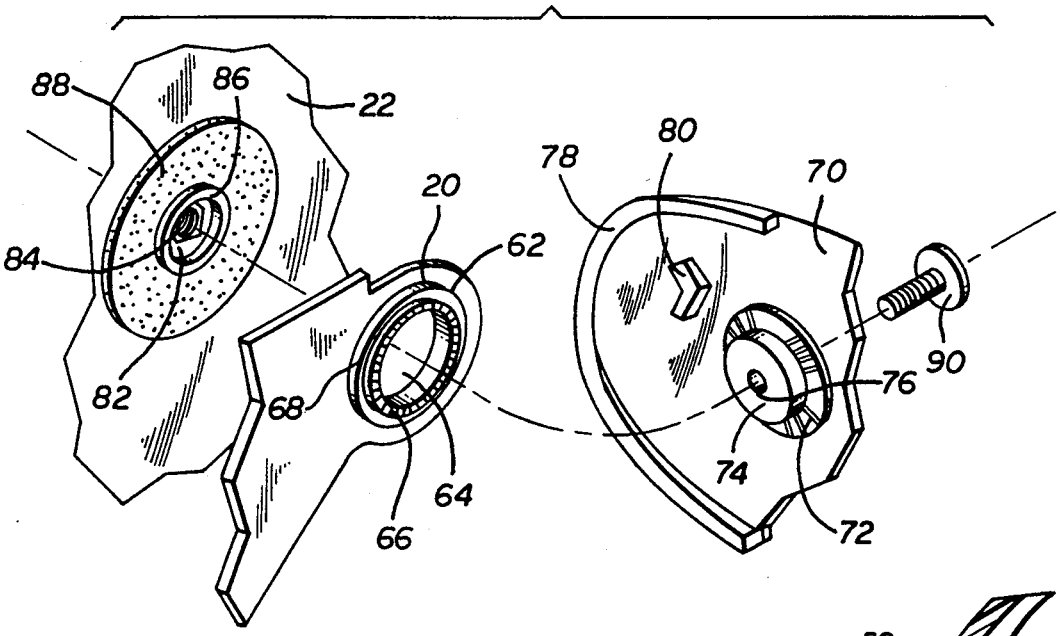
FIG. 6
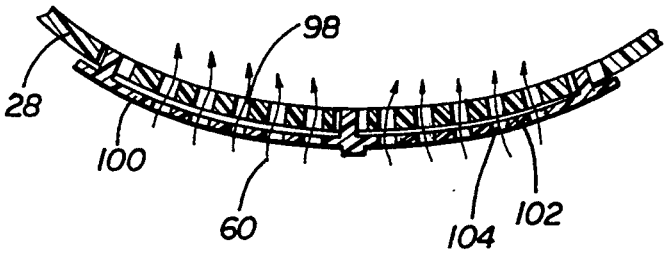
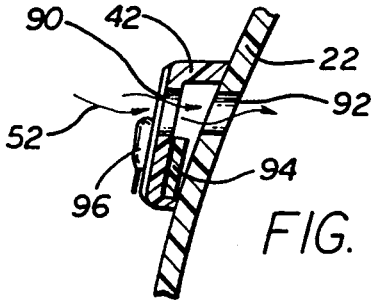
FIG. 5
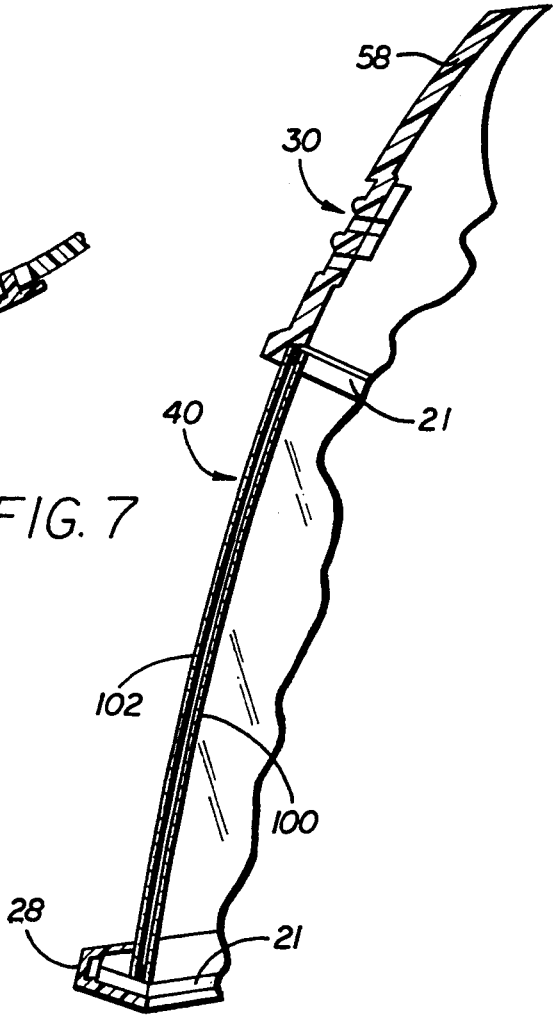
FIG. 7

COLD WEATHER VENTILATION SYSTEM FOR FACESHIELD DEFOGGING

FIELD OF THE INVENTION

The present invention relates to a ventilation system for defogging a sports helmet face shield in cold weather, and more particularly to a ventilation system that will defog the face shield without cooling the interior of the helmet.

BACKGROUND

Many people wear protective safety helmets while enjoying outdoor riding activities such as snowmobiling, motorcycle riding and bicycling. Most helmets for snowmobiling and motorcycling, and some for bicycling, include a transparent or reflective face shield through which a rider can see. Unfortunately, moisture from the rider's breath tends to condense on the interior of the face shield and cloud the rider's vision. Face shield condensation is a particularly acute problem in cold weather because warm breath moisture rapidly fogs an ice-cold shield.

Various inventors have proposed schemes for reducing face shield condensation, but these schemes are impractical in very cold weather. Kamata discloses two such approaches in U.S. Pat. Nos. 5,058,212 and 5,093,938, which teach a helmet having an air vent on the helmet just below the face shield. Air flows into the vent and is then directed up along the interior of the face shield. The air ultimately follows a path through the interior of the helmet, finally exiting in the rear of the helmet.

In very cold weather, this flow of cold air through the interior of the helmet carries away substantial heat from the interior of the helmet. The rider becomes uncomfortable and, in the extreme climates often encountered on long snowmobile runs, may become dangerously cold. The rider may choose to shut off the air flow entirely to protect her body heat, but the face shield can quickly become nearly opaque from condensation.

Other proposals suffer from the same defects as Kamata. U.S. Pat. Nos. 5,170,510 (Nava), 4,704,746 (Nava) and 4,612,675 (Broersma) all disclose schemes that cause the defogging air to circulate at least partially throughout the helmet, thereby carrying away important body heat. Additionally, the Nava and Broersma systems cannot yield substantial defogging air flow along the interior of the face shield. Air can exit the helmets only through small exit vents, and there is minimal suction to pull air through the entry vents. This limited air flow can be a problem in very cold weather, where a substantial flow of defogging air is needed to be effective.

SUMMARY OF THE INVENTION

In light of the deficiencies in the prior art, the present invention has a number of objects. A first object is to provide a ventilation system for defogging a face shield in cold weather that will not carry away significant heat from the interior of the helmet. A second object is to provide a replacement face shield assembly having its own cold-weather defogging system. The assembly may be adapted for mounting onto a variety of existing sports helmets, thereby making cold-weather defogging available to riders who already own a helmet.

A third object is to provide a ventilation system that will create a high volume of air flow along the interior of the face shield, so as to prevent shield fogging in very cold weather. A fourth object is to provide a sports helmet with a cold-weather shield defogging ventilation system that can be selectively adjusted to meet varying weather conditions. So, for instance, in warm-weather conditions the rider may adjust the ventilation system to provide both defogging air flow and interior helmet ventilation.

Generally stated, a replacement face shield assembly that satisfies the first three objects has a cold-weather ventilation system for face shield defogging without circulating cold air through the interior of the sports helmet. The assembly has a face shield frame that carries a face shield. The frame has a lower face shield frame vent and an upper face shield frame vent. The upper portion of the frame may have an air flow director which, when the assembly is mounted on a sports helmet, directs air entering the upper frame vent. The directed air flow creates a vacuum that draws air entering the lower frame vent substantially upward along an interior surface of said face shield.

A replacement face shield assembly as described above may have several additional features. The assembly may include upper and lower face shield frame vent covers for selectively opening and closing the upper and lower frame vents. The face shield may be a double lens shield comprising two shield lenses that may be separated by a slight space. The face shield frame may have end tabs for mounting onto a sports helmet. The end tabs may have an aperture and upraised teeth to interact with a face shield ratchet system for incrementally raising and lowering the face shield.

Generally stated, a sports helmet assembly that satisfies the fourth object has a versatile, adjustable ventilation system which can operate in a defog-only mode in cold weather, a defog and interior ventilation mode in warmer weather, and an interior ventilation-only mode when no defogging is desired. The assembly includes a sports helmet with at least one helmet air entry vent on a front portion of the helmet and at least one air exit vent on a rear helmet portion.

The helmet assembly also includes a face shield frame that carries a face shield and is rotatably mounted onto the sports helmet. The frame has lower and upper frame vents located on the lower frame portion. The helmet entry vent and the frame vents may be selectively opened and closed. The upper portion of the frame has an air flow director which, when the upper and lower frame vents are open, directs air entering the upper frame vent to flow along the exterior of said helmet. A vacuum then draws air from the lower frame vent in a substantially upward direction along an interior surface of the face shield.

In one embodiment, the face shield frame may have end tabs, each of which has an aperture and ratchet teeth. The assembly may include shield covers mounted to the helmet with the shield covers covering the end tabs. Each shield cover may have shield cover teeth to interact with the ratchet teeth on the face shield frame to enable a user to incrementally raise and lower said face shield frame.

Other objects, features and advantages of the invention will become apparent from a consideration of the following detailed description and the accompanying drawings.

BRIEF DESCRIPTION OF THE DRAWINGS

FIG. 4 is an exploded detail view showing the components of a ratchet system that allows the user to incrementally raise and lower the face shield frame;

FIG. 5 is a sectional view of the lower helmet vent taken along section 5—5 of FIG. 1; and FIG. 6 is a sectional view of the lower face shield frame vent taken along section 6—6 of FIG. 1.

FIG. 7 is a cross-sectional view taken of FIG. 1.

DETAILED DESCRIPTION OF A PREFERRED EMBODIMENT

Figure 1:
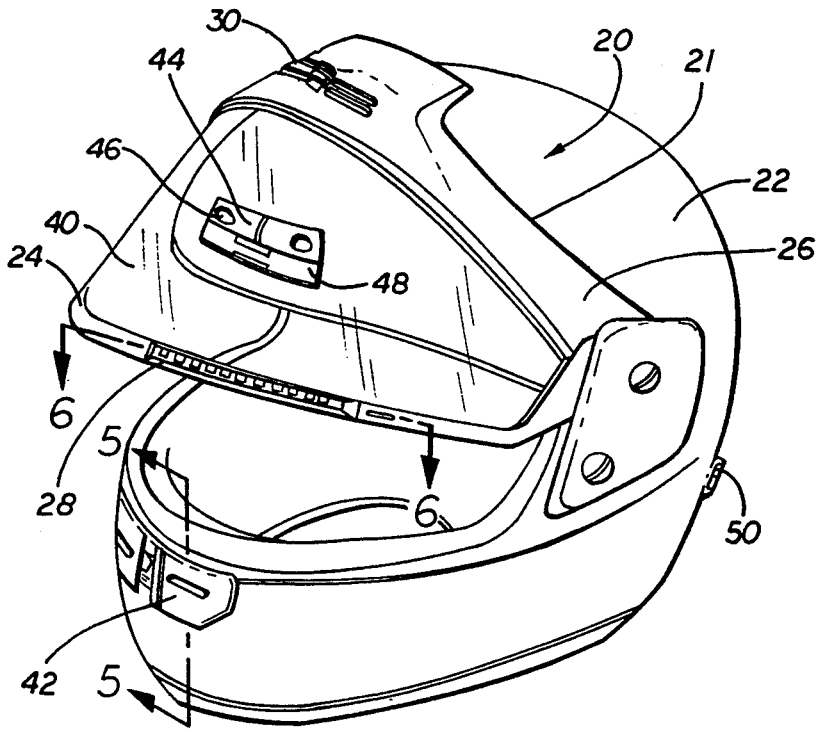
FIG. 1 is a perspective view showing a face shield frame having ventilation for face shield defogging rotatably mounted onto a sports helmet.

Referring more particularly to the drawings, FIG. 1 shows a replacement shield 20 mounted onto a sports helmet body 22, which is typically a snowmobile, motorcycle or bicycle helmet. Replacement shield 20 has a lower face shield frame 24 and an upper face shield frame 26, which together comprise face shield frame 21. Lower face shield frame 24 includes a lower face shield frame vent 28, and upper face shield frame 26 includes an upper face shield frame vent 30.

Face shield frame 20 carries face shield 40, which may consist of one or more lenses. Face shield 40 may be a double lens shield comprising an inner shield 100 and an outer shield 102 separated by an air space. FIG. 7 is a cross-sectional view taken across the face shield 40 of FIG. 1 showing such a double lens shield 40 carried by face shield frame 21. Such double lens shields are well-suited to cold weather applications because the air space helps insulate the inner shield layer from the cold outer shield layer, thereby reducing shield fogging.

Helmet body 22 includes a lower helmet vent 42 and an upper helmet vent 44 on the front portion of the helmet. Upper helmet vent 44 includes vent apertures 46 and a sliding vent cover 48, which can slide upwards into a closed position to cover vent apertures 46. One or more air exit vents 50 are located on a rear portion of helmet body 22.

FIG. 5 is a sectional view of lower helmet vent 42 taken along section 5—5 of FIG. 1. Vent 42 includes two vent apertures 90 and helmet apertures 92. When the vent is open, air 52 flows into apertures 92 and into the interior of the helmet. A vertically sliding vent cover 94 is connected to knob 96. To close vent 42, the user slides knob 96 upward, thereby blocking aperture 90 with vent cover 94. Upper face shield frame vent 30, shown in FIGS. 1-3, also includes a vertically sliding vent cover.

FIG. 6 is a sectional view of lower face shield frame vent 28 taken along section 6—6 of FIG. 1. Vent 28 includes apertures 98 and a horizontally sliding vent cover 100. Vent cover 100 has solid portions 102 interspersed with apertures 104. FIG. 6 shows vent 28 in an open position allowing air 60 to flow through apertures 104 and up along the interior surface of face shield 40. The user may selectively close vent 28 by horizontally sliding vent cover 100 so that solid portions 102 block apertures 98.

Figure 2:
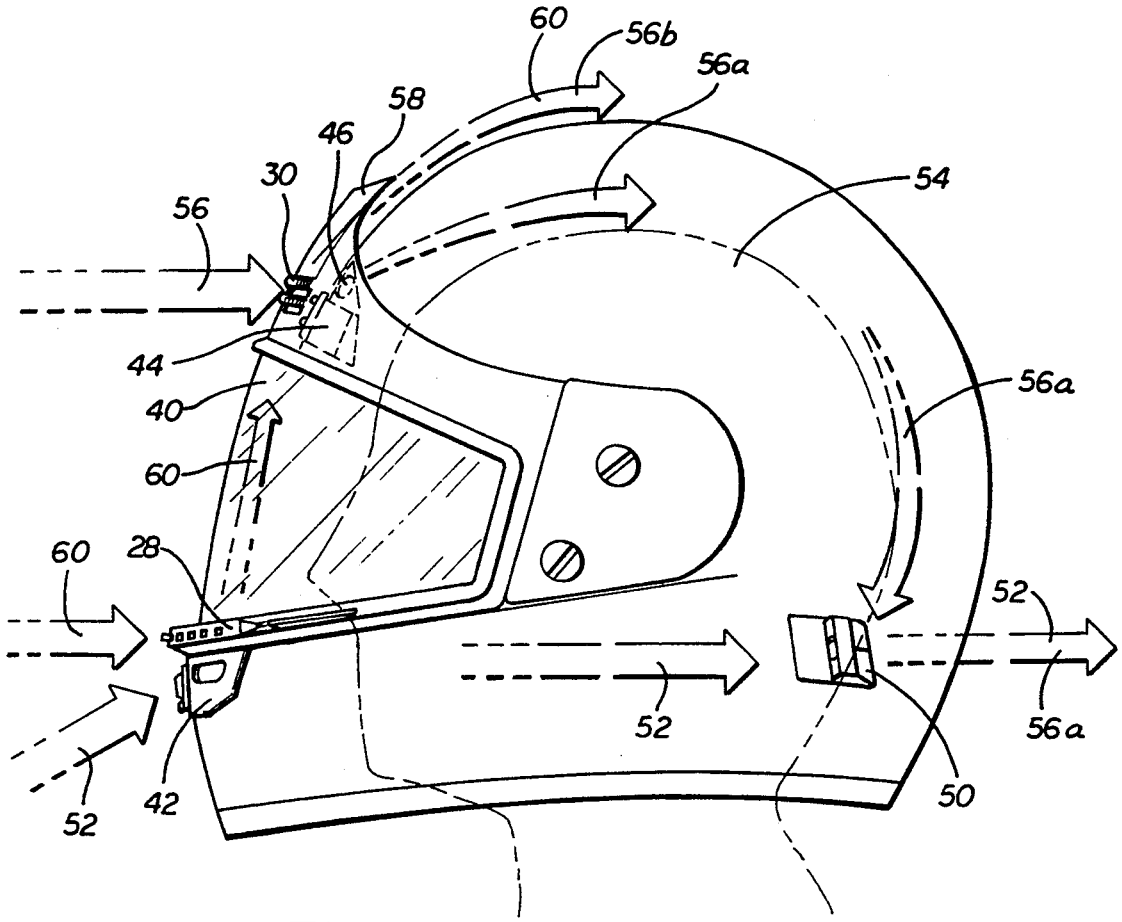
FIG. 2 is a side view showing the air flow pattern when the vents on the face shield frame and helmet are all open.

FIG. 2 illustrates the air flow pattern when all of the shield frame and helmet vents are open and the helmet is in use. Air 52 enters lower helmet vent 42, flows around the side of the face of rider 54, and exits out exit vents 50. Air 56 enters upper face shield frame vent 30 and then splits into two separate flows. Some of air 56 flows through upper helmet vent apertures 46 as air **56*a*, around the top of rider 54's head, and exits out exit vents 50. Air flow director 58 directs the remainder 56*b* of air 56 to flow along the exterior the helmet body. This flow along the helmet exterior creates a vacuum that draws air 60 through lower frame vent 28 and upwardly along the interior surface of face shield 40. Air 60 then joins air 56*b*** and flows about the exterior of the helmet. The air flowing along the interior surface of the face shield defogs the shield.

Figure 3:
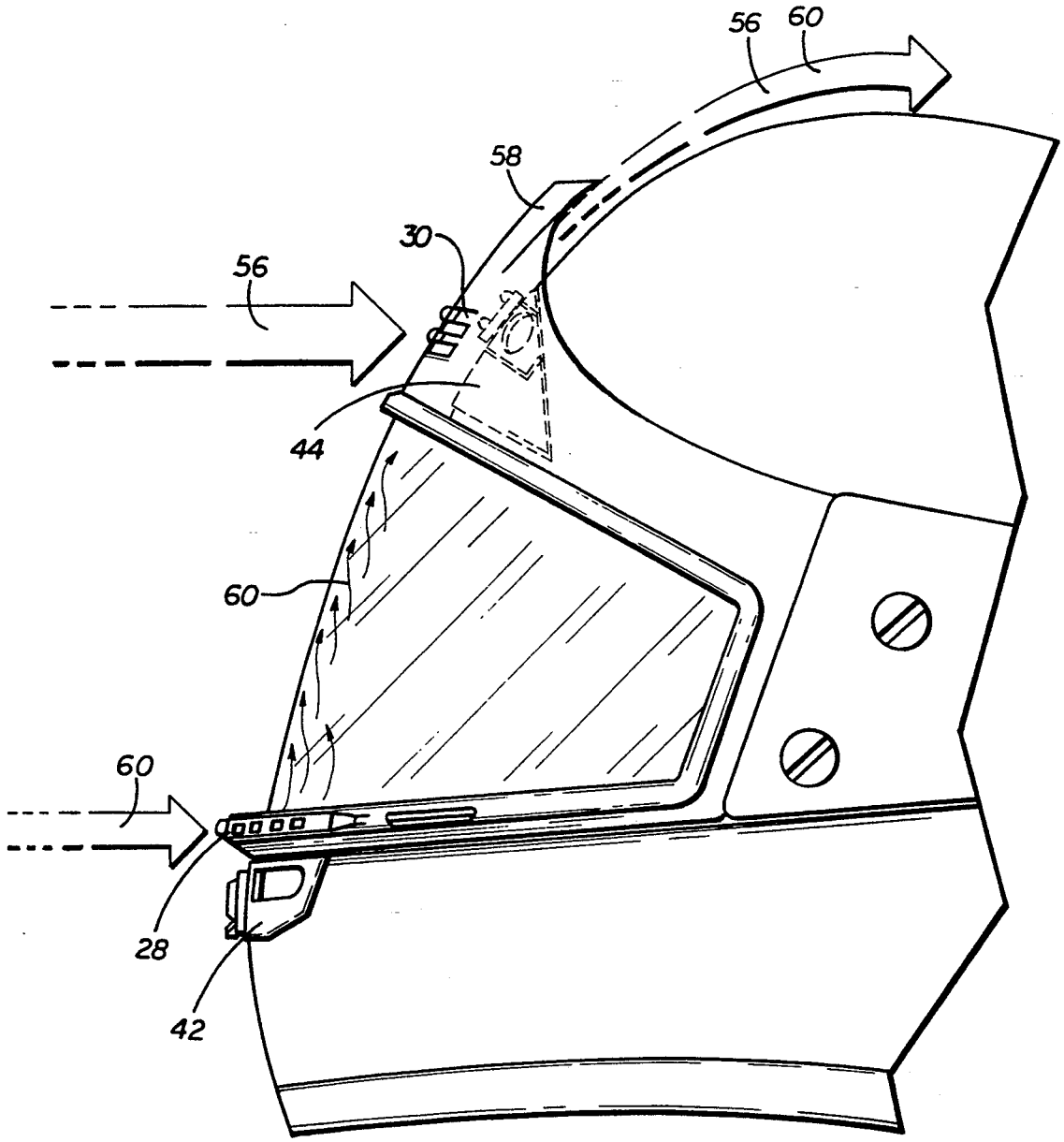
FIG. 3 is a detail view showing the air flow pattern when the vents on the face shield frame are open but the vents on the helmet are closed.

In cold weather, the rider may close the helmet vents 42 and 44 to prevent cold air from flowing through the interior of the helmet, which would remove substantial body heat from the helmet. FIG. 3 shows that with vents 42 and 44 closed, air 56 enters upper face shield frame vent 30. Air flow director 58 then directs the air to flow along the exterior the helmet body. The flow along the helmet exterior creates a vacuum that draws air 60 through lower frame vent 28, upwardly along the interior surface of face shield 40, and finally out over the exterior of helmet body 22. The vacuum enables the present system to draw a high volume of defogging air along the interior surface of the shield. However, very little cold air, if any, circulates within the helmet in this defog-only mode.

In slightly warmer weather, the user may switch to the defog and interior ventilation mode of FIG. 2 by opening helmet vents 42 and 44 and face shield frame vents 28 and 30. In even warmer weather, when face shield condensation is not a problem, the rider may want to switch to an interior ventilation-only mode. She would then close the face shield frame vents 28 and 30 but keep helmet vents 42 and 44 open.

In a preferred embodiment of the present invention, face shield frame 20 is pivotally mounted on helmet body 22. A helmet assembly may be provided with a ratchet system that enables a user to incrementally raise and lower the face shield frame. FIG. 1 shows face shield frame 20 in a partially open position. FIG. 2 shows the face shield frame after the user has ratchetted the frame down into a closed position.

FIG. 4 illustrates the principal components of one such ratchet system. The system includes two face shield covers 70, and components on helmet body 22 and face shield frame 20. Face shield frame 20 includes two end tabs 62, one on either end of the frame. Each end tab has an aperture 64 surrounded by a ring of upraised ratchet teeth 66. Raised rim 68 structurally reinforces upraised ring 66.

A face shield cover 70 includes shield cover teeth 72 and a flange 74 with a bolt hole aperture 76. Shield cover 70 also includes an edge rim 78 and a side brace 80 to put the shield cover into contact with the helmet when mounted as in FIG. 1. Helmet 22 includes a well 82 which includes an embedded nut or threaded shaft 84. Raised ring 86 surrounds the well, and a felt pad 88 surrounds raised ring 86.

When the components of the ratchet system are in engagement as in FIG. 1, shield cover flange 74 passes through face shield frame end tab aperture 64 and into helmet well 82. A bolt 90 passes through shield cover bolt hole 76, through aperture 64 and screws into embedded nut 84. Face shield frame 26 mounts onto raised ring 86, and felt pad 88 protects helmet body 22 as the user raises and lowers the face shield.

Additionally, the teeth of raised rim of upraised teeth 66 engage with shield cover teeth 72. The ratcheting effect occurs when the user rotates the face shield frame, causing ratchet teeth 66 to move relative to the shield cover teeth 72. When the user stops rotating the face shield frame, the interaction of the teeth prevents the face shield frame from rotating in either direction under the mere influence of wind or road shocks.

In conclusion, it is to be understood that the foregoing detailed description and the accompanying drawings relate to preferred embodiments of the invention. Various changes and modifications may be made without departing from the spirit and scope of the invention. Thus, by way of example and not of limitation, replacement face shield frame 20 may be adapted for use on a wide variety of existing helmets. Consequently, frame 20 may be provided with whatever teeth, apertures, and hardware that are necessary for use on a particular brand and model of helmet. Frame 20 is typically made of plastic, but may also be made of aluminum or a composite material. Face shield 40 may have a coating to filter ultra-violet rays that would otherwise pass through the shield. Vents 28, 30, 42 and 44 may have a variety of different opening and closing means. Accordingly, the present invention is not limited to the specific embodiments shown in the drawings and described in the detailed description.

I claim:

1. A replacement sports helmet face shield assembly having a cold-weather ventilation system for face shield defogging without circulating cold air through the interior of the sports helmet comprising:

a face shield frame;

a face shield carried by said face shield frame;

a lower face shield frame vent located on a lower portion of said face shield frame; and an upper face shield frame vent located on an upper portion of said face shield frame, said upper portion having an air flow director which, when said frame is mounted on the helmet directs air about the exterior of the helmet after the air has passed through said upper face shield frame vent, thereby creating a vacuum which draws air entering said lower face shield frame vent substantially upward along an interior surface of said face shield, said air flow director comprising an upwardly-extending fin-like portion which is integral to said face shield frame, said fin-like portion being located immediately above said upper face shield frame vent, said upper face shield frame vent comprising a series of spaced apertures and a sliding member which a user may slide to block said spaced apertures to prevent air flow through said upper vent.

2. A face shield assembly as defined in claim 1 wherein the assembly further comprises a lower face shield frame vent cover for selectively opening and closing said lower face shield frame vent.

3. A face shield assembly as defined in claim 1 wherein the face shield is a double lens shield comprising an inner shield and an outer shield carried in a spaced relationship by said face shield frame.

4. A face shield as defined in claim 1 wherein said face shield frame further comprises end tabs for mounting onto a helmet.

5. A face shield assembly as defined in claim 4 wherein each of said face shield frame end tabs have an aperture and upraised teeth so that said face shield frame may interact with a face shield ratchet system.

6. A face shield assembly as defined in claim 5 wherein said upraised teeth are arranged in a ring surrounding said aperture.

7. A replacement sports helmet face shield assembly as defined in claim 1 wherein said face shield frame comprises two lenses carried in a spaced, parallel relationship by said face shield frame.

8. A replacement face shield assembly for snowmobile, motorcycle and bicycle helmets, the face shield assembly having ventilation for cold-weather face shield defogging and comprising:

a face shield frame;

a lower face shield frame vent located on a lower portion of said face shield frame;

an upper face shield frame vent located on an upper portion of said face shield frame;

a face shield carried by said face shield frame; and a substantially upwardly-extending deflecting member which is integral to said upper face shield frame for directing air that has entered the upper vent to flow about the exterior of a helmet when said face shield frame is mounted on the helmet, said deflecting member being located immediately above said upper vent.

9. A replacement face shield assembly as defined in claim 8 further comprising vent covers for selectively opening and closing said lower and upper face shield frame vents.

10. A face shield as defined in claim 8 wherein said face shield frame further comprises end tabs for mounting onto a helmet.

11. A face shield assembly as defined in claim 10 wherein each of said face shield frame end tabs has an aperture and upraised teeth, whereby said face shield frame may interact with a face shield ratchet system.

12. A face shield assembly as defined in claim 11 wherein said upraised teeth are arranged in a ring surrounding said aperture.

13. A face shield assembly as defined in claim 8 wherein said face shield is a double lens shield comprising two lenses carried by said face shield frame in a spaced relationship.

14. A sports helmet assembly having a versatile, adjustable ventilation system which can operate in a defog-only mode in cold weather, a defog and interior ventilation mode in warmer weather, and an interior ventilation-only mode when no defogging is desired, the helmet assembly comprising:

a sports helmet having a front helmet portion, a rear helmet portion, and an exterior;

at least one helmet air entry vent on said front helmet portion, said helmet vent having a sliding switch to selectively open and close the helmet vent;

at least one air exit vent on said rear helmet portion;

a face shield frame having a lower frame portion and an upper frame portion, said frame being pivotally mounted onto said sports helmet;

a lower face shield frame vent located on said lower frame portion, said lower face shield frame vent having a sliding switch to selectively open and close said lower vent;

an upper face shield frame vent located on said upper frame portion, said upper face shield having a sliding switch to selectively open and close said upper vent; and a face shield carried by said face shield frame;

wherein said upper frame portion has an air flow director which, when said upper and lower face shield frame vents are open, directs air entering said upper face shield frame vent to flow along the exterior of said helmet, thereby creating a vacuum which draws air from said lower face shield frame vent in a substantially upward direction along an interior surface of said face shield.

15. A ventilation system as defined in claim 14 wherein said face shield comprises two lenses carried by said face shield frame in a spaced relationship.

16. A ventilation system as defined in claim 14 wherein said system further includes vent covers for selectively opening and closing said helmet air entry vent, said lower face shield frame vent, and said upper face shield frame vent.

17. A ventilation system as defined in claim 14 wherein:

said face shield frame further comprises end tabs, each of said end tabs having an aperture and ratchet teeth; and said ventilation system further comprises shield covers mounted to said helmet, said shield covers covering said face shield frame end tabs, each shield cover having shield cover teeth to interact with said face shield frame ratchet teeth to enable a user to incrementally raise and lower said face shield frame.

18. A sports helmet assembly as defined in claim 14 wherein said face shield frame further includes two end tabs, each end tab having a mounting aperture, and said sports helmet has two raised portions onto each of which one of said end tabs mounts at one of said apertures, thereby providing pivotal mounting of said frame onto said helmet.

19. A sports helmet assembly as defined in claim 14 wherein said assembly includes means for pivotally mounting said face shield frame onto said helmet.

20. A replacement face shield assembly for a snowmobile helmet which has a cold weather ventilation system for face shield defogging comprising:

a substantially convex face shield frame having an interior side, an exterior side and a face shield opening;

a substantially convex face shield carried by said face shield frame, said face shield extending across the full width and length of said face shield opening;

a lower face shield frame vent located on a lower portion of said face shield frame immediately below said face shield, said lower vent having a plurality of spaced apertures and a sliding lower vent cover mounted adjacent to said plurality of spaced apertures, said sliding vent cover having a closed position in which said vent cover blocks said spaced apertures and prevents air from entering said spaced apertures, and an open position in which said vent cover allows air to flow from said exterior side of said face shield frame through said plurality of spaced apertures to said interior side of said face shield frame, said sliding lower vent cover being slidable from said open position to said closed position;

an upper face shield frame vent located on an upper portion of said face shield frame above said face shield, said upper frame vent having a plurality of spaced air intake slots and a sliding slot cover, said sliding slot cover being slidable from a slot open position, in which air may flow through said slots from said exterior side of said face shield frame to said interior side, to a slot closed position in which said slot cover blocks said slots and prevents air from flowing through said slots;

said face shield frame further comprising a substantially upwardly projecting portion which is integral to said face shield frame and which is located immediately above said plurality of spaced air intake slots on said upper portion of said face shield frame; and said face shield frame having two end tabs, one at each end of said face shield frame, each end tab having a mounting aperture which is surrounded by a ring of upraised ratchet teeth.

* * * * *